US007950961B2

(12) United States Patent
Chabalowski et al.

(10) Patent No.: US 7,950,961 B2
(45) Date of Patent: May 31, 2011

(54) HARD-LINE COAXIAL CABLE CONNECTOR WITH SLOTTED SHAFT

(75) Inventors: Michael Chabalowski, Crystal Lake, IL (US); Allen L. Malloy, Elmira Heights, NY (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 12/640,039

(22) Filed: Dec. 17, 2009

(65) Prior Publication Data

US 2010/0151728 A1 Jun. 17, 2010

Related U.S. Application Data

(60) Provisional application No. 61/138,336, filed on Dec. 17, 2008.

(51) Int. Cl.
*H01R 9/05* (2006.01)

(52) U.S. Cl. ..... 439/584; 439/578

(58) Field of Classification Search ..... 439/578, 439/583, 584

See application file for complete search history.

(56) References Cited

U.S. PATENT DOCUMENTS

| | | | |
|---|---|---|---|
| 4,408,821 | A | 10/1983 | Forney, Jr. |
| 4,469,390 | A | 9/1984 | LeVine et al. |
| 5,120,260 | A | 6/1992 | Jackson |
| 5,352,134 | A | 10/1994 | Jacobsen et al. |
| 6,019,636 | A | 2/2000 | Langham |
| 6,042,422 | A | 3/2000 | Youtsey |
| 6,102,738 | A | 8/2000 | Macek et al. |
| 6,309,251 | B1 | 10/2001 | Tang |
| 6,331,123 | B1 | 12/2001 | Rodrigues |
| 6,530,807 | B2 | 3/2003 | Rodrigues et al. |
| 6,884,115 | B2 | 4/2005 | Malloy |

*Primary Examiner* — Khiem Nguyen

(74) *Attorney, Agent, or Firm* — Foley & Lardner LLP

(57) ABSTRACT

A coaxial cable connector which includes a back nut housing having a rearward cable receiving end and a forward end opposite the rearward end, a front nut assembly coupled to the forward end of the back nut housing, a tubular insert shaft supported within the back nut housing, a tubular gripping ferrule radially surrounding the insert shaft and a tubular holder sleeve radially surrounding at least a portion of the gripping ferrule. The axial movement of the holder sleeve causes the gripping ferrule to radially compress around the insert shaft. The insert shaft has a rearward end and an axial slot extending from the rearward end in a forward direction, wherein the slot permits the rearward end of the insert shaft to radially compress upon the radial compression of the gripping ferrule to make removal of a cable from the connector easier.

20 Claims, 6 Drawing Sheets

HARD-LINE COAXIAL CABLE CONNECTOR WITH SLOTTED SHAFT

CROSS-REFERENCE TO RELATED APPLICATIONS

This application claims the benefit of U.S. Provisional Application No. 61/138,336, filed on Dec. 17, 2008, the specification of which is incorporated by reference herein in its entirety for all purposes.

BACKGROUND OF THE INVENTION

The present invention relates generally to connectors for terminating coaxial cable. More particularly, the present invention relates to axially compressible connectors for hard-line or semi-rigid coaxial cables.

Coaxial cables are commonly used in the cable television industry to carry cable TV signals to television sets in homes, businesses, and other locations. A hard-line coaxial cable may be used to carry the signals in distribution systems exterior to these locations and a flexible coaxial cable is then often used to carry the signals within the interior of these locations. Hard-line or semi-rigid coaxial cable is also used where a high degree of radio-frequency (RF) shielding is required.

The hard-line cable includes a solid wire core or inner conductor, typically of copper or copper-clad aluminum, surrounded by a solid tubular outer conductor. The outer conductor is also usually made of copper or aluminum. Dielectric material or insulation separates the inner and outer conductors. The outer conductor is covered with a cable jacket or sheath of plastic to provide protection against corrosion and weathering.

One type of connector for hard-line coaxial cables employs radial compression crimping to electrically and mechanically connect parts of the connector to the cable. Typically, a sleeve within the connector is compressed by a crimping tool. The sleeve may have slots, flutes, threads and the like to assist in the mechanical connection between the sleeve and the outer conductor of the cable. Such connectors are shown, for example, in U.S. Pat. Nos. 4,408,821, 4,469,390, 5,120,260 and 6,042,422.

Radial crimping, however, often does not apply compressive force evenly to the outer conductor or alternatively to the outer tubular jacket of the outer connector. Such uneven compression can form channels for infiltration of moisture into the coaxial cable connection and consequently lead to the degradation of the signal carried by the cable.

Threaded cable connectors, as shown in U.S. Pat. Nos. 5,352,134 and 6,019,636, have been employed to provide more even compression of the connector. Such connectors typically utilize some form of locking mechanism that radially compresses the outer conductor of the cable against a tubular insert shaft upon axial threaded movement of the connector components to retain the cable in the hard-line connector. The locking mechanism may include a conical sleeve surrounded by an outer sleeve which forces the conical sleeve to radially compress upon axial movement of the outer sleeve with respect to the conical sleeve. The length of the conical closure sleeve typically closes the full length of the mechanism with equal forces around the circumference of the insert shaft. The resulting forces closing down on the coaxial cable compress the cable around the outside of the insert shaft creating a formed bond on the outside surface.

One problem with conventional hard-line connectors is the difficulty involved in removing a cable from the connector upon disassembly of the connection. Depending on the type of cable, insulative material or dielectric is often left on the inside of the outer conductor of the cable after coring or cable preparation. This can lead to high forces required to remove the cable from the connector if the bond between the inner diameter of the outer conductor and the outer diameter of the insert shaft are not broken mechanically when the connector body and the back-nut are being removed from the coaxial cable.

Typical connector removal from the cable is by hand. If the connector can not be removed, installers tend to use devices, such as hammers and wrenches, to hit or bang the connector off the cable. If this fails, the installers will cut the connector off the cable and discard the connector.

Accordingly, it would be desirable to provide a hard-line coaxial cable connector that is easily removed from the coaxial cable after use.

OBJECTS AND SUMMARY OF THE INVENTION

It is an object of the present invention to provide a coaxial cable connector for terminating a coaxial cable.

It is a further object of the present invention to provide a hard-line coaxial cable connector that is easily removed from the coaxial cable after use.

In the efficient attainment of these and other objects, the present invention provides a coaxial cable connector. The connector of the present invention generally includes a back nut housing having a rearward cable receiving end and a forward end opposite the rearward end, a front nut assembly coupled to the forward end of the back nut housing, a tubular insert shaft supported within the back nut housing, a tubular gripping ferrule radially surrounding the insert shaft and a tubular holder sleeve radially surrounding at least a portion of the gripping ferrule. The holder sleeve is driven in a rearward axial direction into engagement with the gripping ferrule upon coupling of the front nut assembly to the back nut housing. The axial movement of the holder sleeve causes the gripping ferrule to radially compress around the insert shaft. The insert shaft has a rearward end and an axial slot extending from the rearward end in a forward direction, wherein the slot permits the rearward end of the insert shaft to radially compress upon the radial compression of the gripping ferrule to make removal of a cable from the connector easier.

In a preferred embodiment, the tubular insert shaft includes a tubular body and a radially enlarged flanged head portion disposed on a forward end of the tubular body. The slot preferably has a length of about half the length of the tubular insert shaft and further preferably extends from the rearward end of the tubular insert shaft and terminates at a point midway along the length of the tubular gripping ferrule. In this manner, the termination point of the slot divides the gripping ferrule into a forward half defining an area of compression having substantially uniform circumferential contact around the insert shaft and a rearward half defining an area of compression in which radial compressive forces diminish in a rearward direction opposite the forward direction.

The present invention further involves a method for uniformly distributing compressive forces applied by a coaxial cable connector gripping ferrule upon an outer conductor of a coaxial cable. The method includes the steps of removing a length of cable dielectric from an end of a coaxial cable thereby leaving an annular cavity in the cable end between an outer connector and an inner connector of the cable. A tubular shaft is then inserted in the annular cavity of the cable end, wherein the tubular shaft has a rearward end and an axial slot extending from the rearward end in a forward direction. A tubular gripping ferrule is provided around an outer surface of the cable outer conductor radially opposite the tubular shaft and a tubular holder sleeve is driven in a rearward direction opposite the forward direction, whereby the sleeve engages the gripping ferrule causing the gripping ferrule to radially compress against the cable outer conductor around the tubular shaft, wherein the slot in the shaft permits the rearward end of the shaft to radially deflect thereby absorbing a portion of the rearward compressive forces applied by the gripping ferrule to more uniformly distribute the compressive forces applied by the gripping ferrule along the length of the gripping ferrule.

A preferred form of the hard-line coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
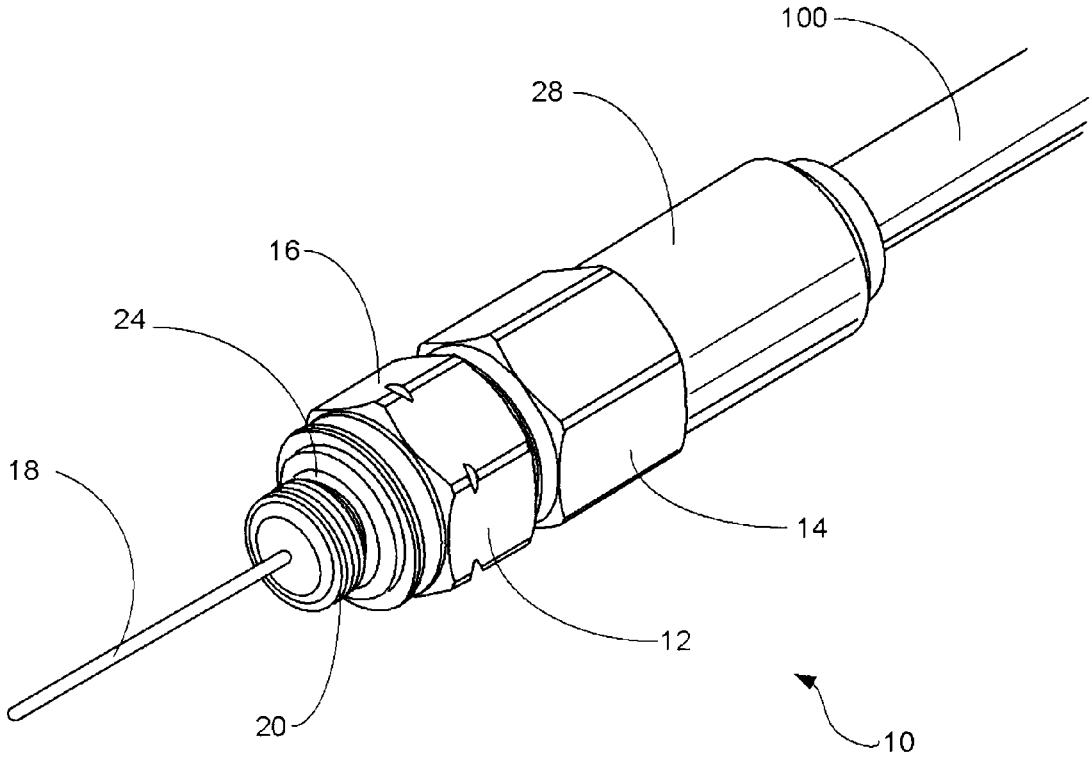
FIG. 1 is a front perspective view of a preferred embodiment of the coaxial cable connector of the present invention.
Figure 2:
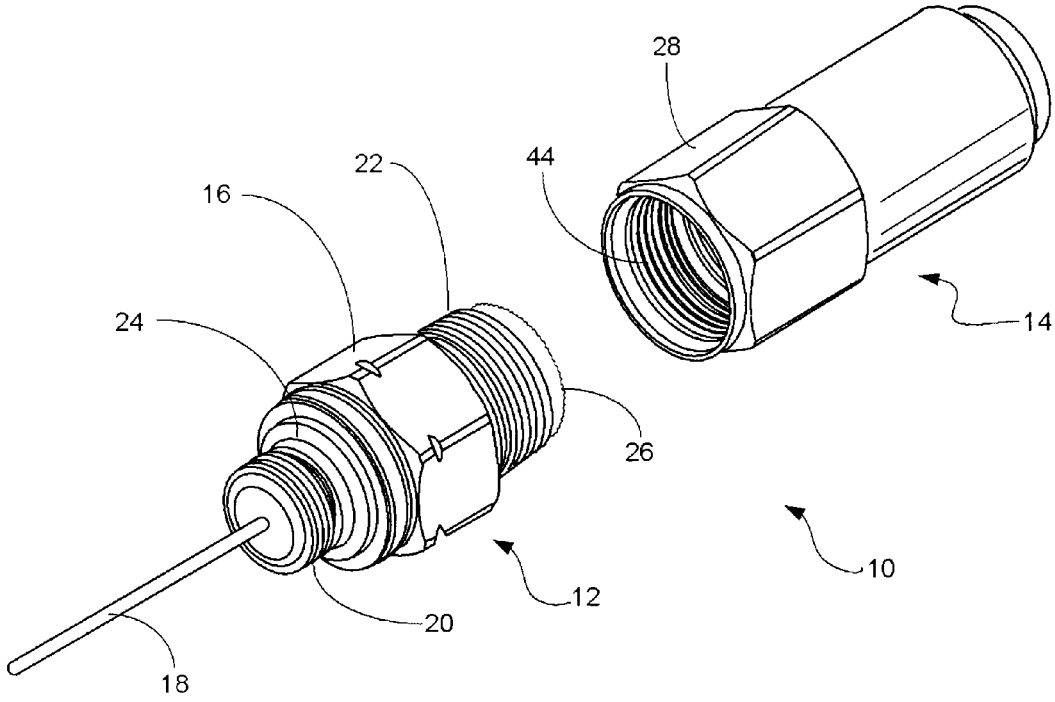
FIG. 2 is a partially exploded perspective view of the connector shown in FIG. 1, showing a front nut assembly separated from a back nut assembly.

Referring first to FIGS. 1 and 2, a connector 10 in accordance with the present invention is depicted. The connector 10 is for hard-line or semi-rigid coaxial cables. The connector 10 includes a front nut assembly 12 and a back nut assembly 14 that are configured to be removably connected while providing both an electrical and mechanical connection therebetween.

Figure 4:
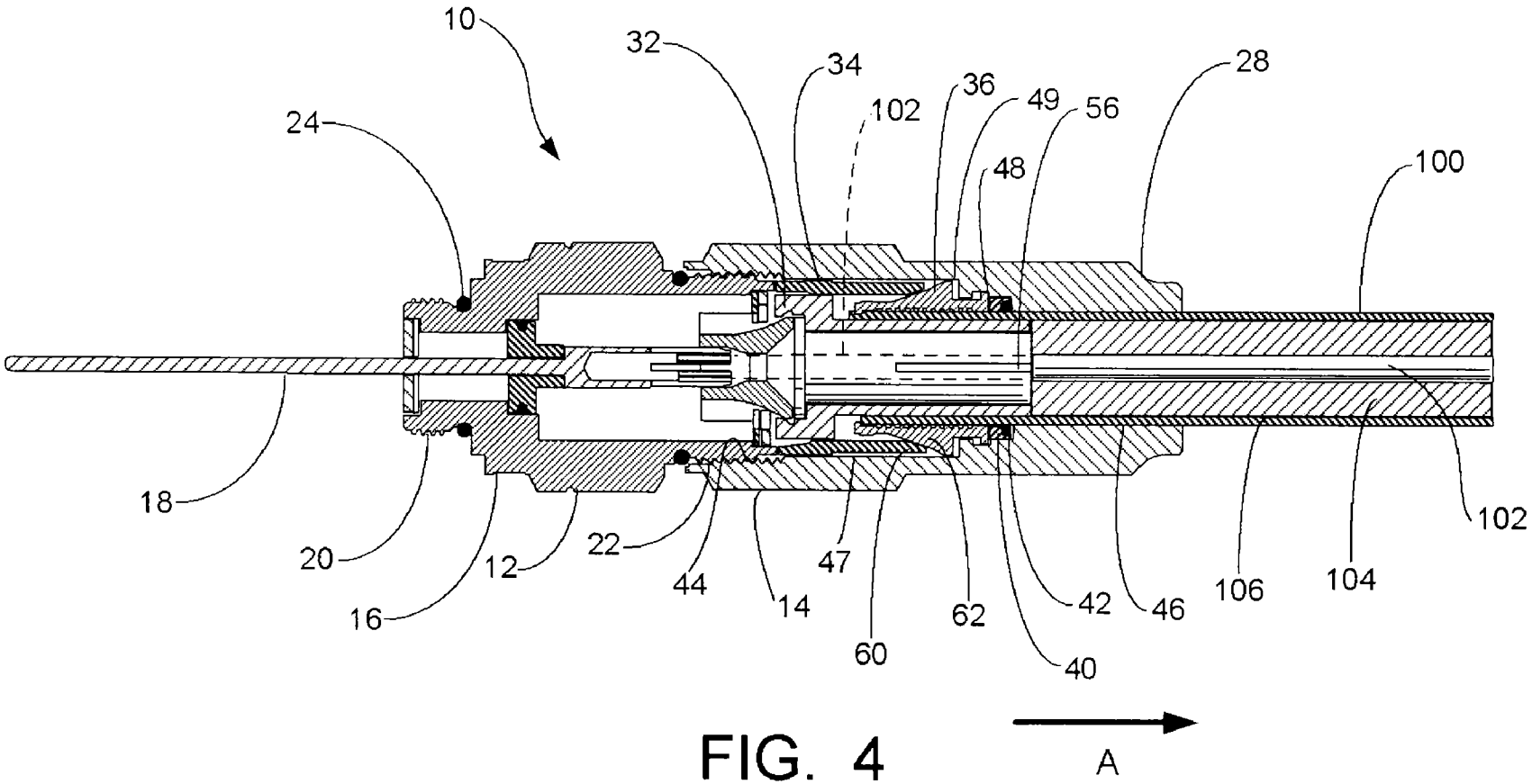
FIG. 4 is a cross-sectional view of the connector shown in FIG. 1 before closure.
Figure 5:
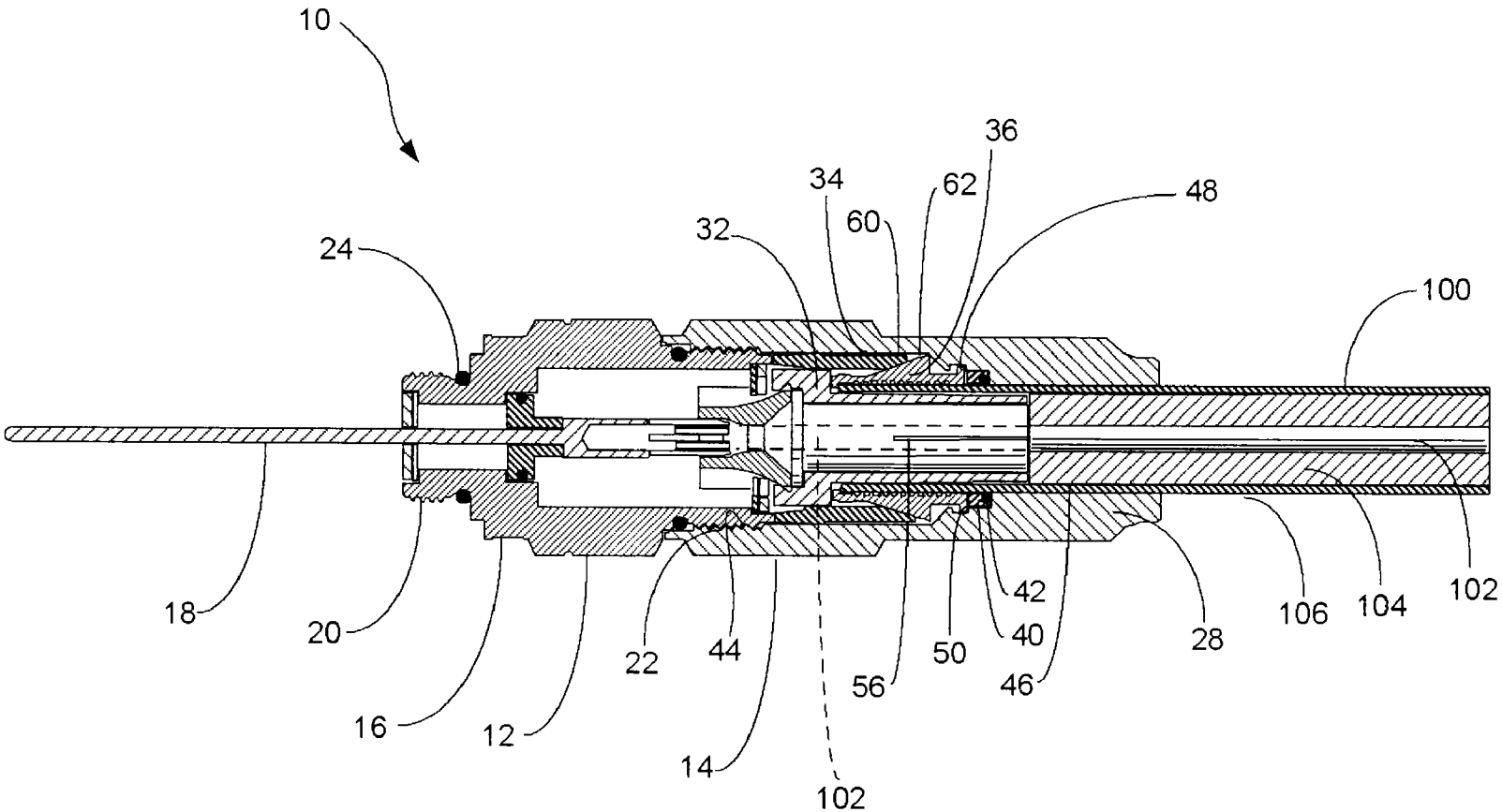
FIG. 5 is a cross-sectional view of the connector shown in FIGS. 1 and 4 after closure.

As also shown in FIGS. 4 and 5, a coaxial cable 100 is inserted into the rearward end of the back nut assembly 14 of the connector 10. Coaxial cables 100 generally include a solid center conductor 102 typically formed from a conductive metal, such as copper, copper clad aluminum, copper clad steel and the like capable of conducting electrical signals therethrough. Surrounding the cable center conductor 102 is a cable dielectric 104, which insulates the cable center conductor to minimize signal loss. The cable dielectric 104 also maintains a spacing between the cable center conductor 102 and a cable outer conductor or shield 106. The cable dielectric 104 is often a plastic material, such as a polyethylene, a fluorinated plastic material, such as a polyethylene or a polytetrafluoroethylene, a fiberglass braid and the like. The cable shield or outer conductor 106 is typically made of metal, such as aluminum or steel, and is often extruded to form a hollow tubular structure with a solid wall having a smooth exterior surface. An insulative cable jacket (not shown) may surround the cable outer conductor 106 to further seal the coaxial cable 100. The cable jacket is typically made of plastic, such as polyvinylchloride, polyethylene, polyurethane, polytetrafluoroethylene.

The structure of the connector 10 includes a plurality of components generally having a coaxial configuration about an axis defined by the center conductor 102 of the coaxial cable 100. The front nut assembly 12 includes an entry body housing 16 supporting a terminal assembly 18 therein. Specifically, the entry body housing 16 is formed with an axial bore configured to cooperatively contain the terminal assembly 18 and is made from an electrically conductive material such as aluminum, brass or the like. The entry body housing 16 is formed with a threaded portion 20 at its forward end and a rearward threaded portion 22 opposite the forward threaded portion. The forward threaded portion 20 is configured to cooperate with devices located in the field that receive the forward end of the pin assembly 18. An O-ring 24 may be provided around the forward threaded portion 30 to improve the seal that is made with a device and a portion of the exterior perimeter of the entry body housing 16 may be provided with a hexagonal shape to accommodate the use of tools during installation.

The rearward threaded portion 22 of the front nut assembly 12 is configured to cooperate with the back nut assembly 14. Specifically, the rearward threaded portion 22 includes a rim face 26 that cooperates with a holder sleeve of the back nut assembly 14, as will be described in further detail below. Preferably, the rim face 26 is configured to interlock with the back nut holder sleeve and is, therefore, formed as a radial knurl.

Figure 3:
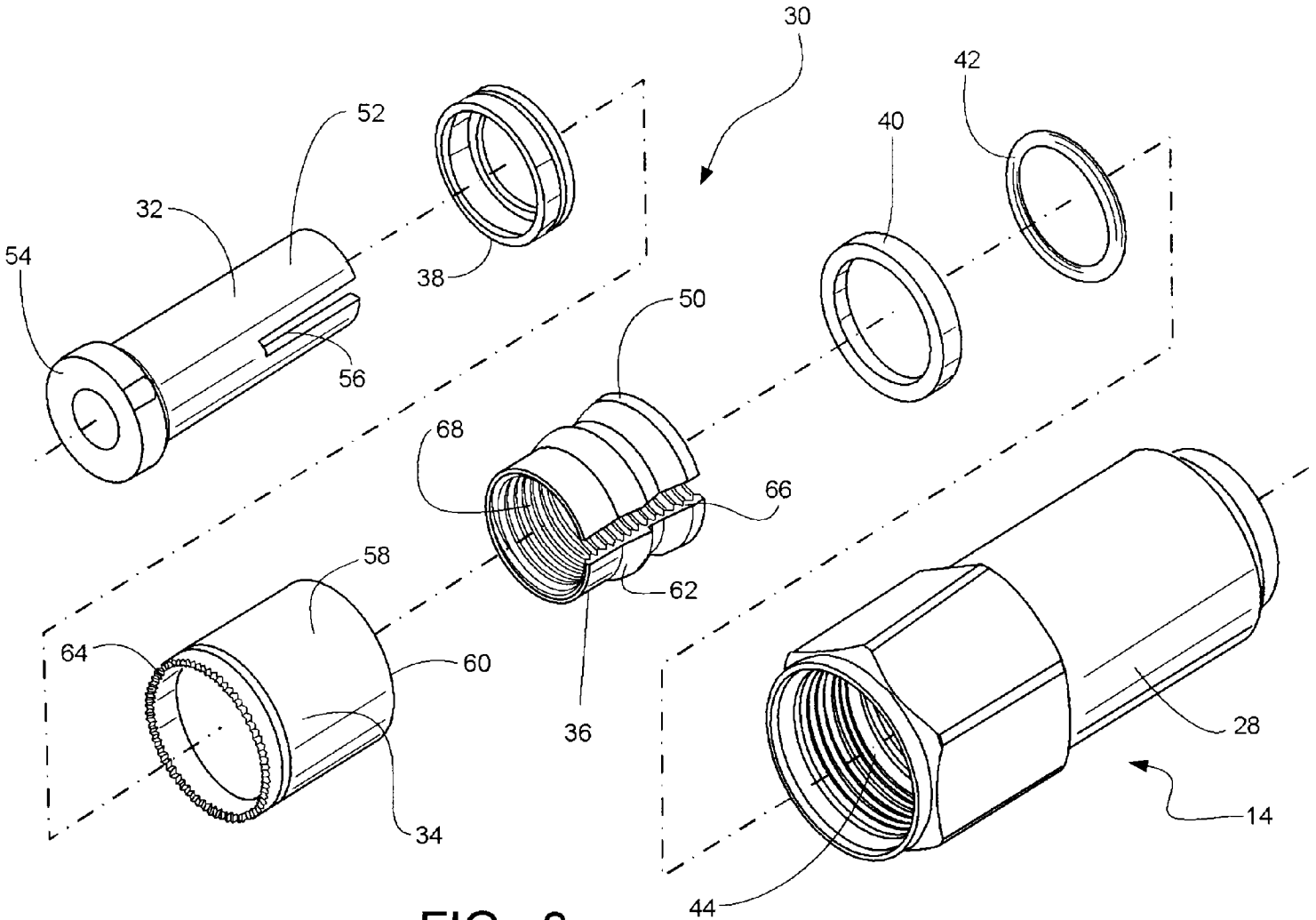
FIG. 3 is an exploded perspective view of the back nut assembly of the connector shown in FIGS. 1 and 2.

Referring additionally to FIGS. 3-5, the back nut assembly 14 of the connector 10 includes a nut housing 28 having an axial bore and a compression subassembly 30 rotatably supported within the axial bore. The compression subassembly 30 generally includes an insert shaft 32, a holder sleeve 34, and a cable gripping ferrule 36 arranged in a coaxial relationship about the central axis of the back nut housing 28.

The compression sub-assembly 30 may further include a snap ring 38, a holder ring 40 and an O-ring 42. The snap ring 38 supports the insert shaft 32 and holds the holder sleeve 34 and the ferrule 36 within the nut housing 28. The holder ring 40 and the cable jacket O-ring 42 improve the seal between the nut housing 28 and the cable 100 upon assembly.

The back nut housing 28 is made from an electrically conductive material, such as aluminum, brass or the like, and includes a forward internally threaded portion 44 that cooperates with the rearward threaded portion 22 of the entry body housing 16 so that the two connector portions may be threadably coupled together. The exterior surface of the back nut housing 28 is preferably provided with a hexagonal shape to accommodate the use of tools to facilitate such threaded coupling.

At its rearward end, the back nut housing 28 is formed with an axial bore 46 dimensioned to receive the outside diameter of the cable 100 in snug fitting relationship. At its forward end, opposite the rearward end, the back nut housing 28 is formed with a forward axial bore 47 communicating with the rearward axial bore 46 and dimensioned to snugly accommodate the outer diameter of the holder sleeve 34. The back nut housing 28 is also preferably formed with an internal annular groove 48 formed in a transition region 49 between the forward and rearward axial bores 47 and 46, as shown in FIGS. 4 and 5. The internal annular groove 48 is sixed for retaining a lip 50 formed on the rearward end of the cable gripping ferrule 36. The groove 48 prevents rearward movement of the gripping ferrule 36 as the gripping ferrule is radially compressed by the axial movement of the holder sleeve 34, as will be discussed in further detail below.

The insert shaft 32 includes a tubular body 52 terminating at a forward flanged head portion 54. The insert shaft 32 is preferably made from a plastic material and includes at least one axial slot 56 formed at the rearward end of the tubular body 52, which, as will be discussed in further detail below, permits the rearward end of the insert shaft 32 to radially compress. The slot 56 is open at the rearward end of the insert shaft 32 and preferably extends roughly half the length of the insert shaft toward the forward flanged head portion 54. The slot length and width determines the amount of forces required to retain the cable and remove cable from the locking mechanism. The use of plastic also provides the desired radial compressibility to the rearward end of the shaft 32 while, at the same time, helps to minimize signal phase problems which can occur if the cable is not properly prepared and dielectric material is not completely removed from the outer conductor and a conductive insert is used.

The outside diameter of the tubular body 52 of the shaft 32 is dimensioned to be fitted within the inner diameter of the outer conductor 106 of the coaxial cable 100. Also, the inside diameter of the tubular body 52 is dimensioned to provide a passageway to receive the center conductor 102 of the cable 100 after the cable has been prepared for termination, wherein a length of the dielectric 104 has been removed from the forward end of the cable.

The holder sleeve 34 is preferably made from an electrically conductive material, such as aluminum or brass, and includes a sleeve body 58 having an exterior surface configured to be received within the forward axial bore 47 of the back nut housing 28. The sleeve body 58 terminates at a rearward edge 60, which engages a ramped portion 62 formed on the outer surface of the ferrule 36 to radially compress the ferrule upon rearward axial movement of the holder sleeve 34.

At its forward edge, opposite the rearward edge 60, the sleeve body further preferably includes a front nut engagement face 64 that cooperates with the rim face 26 of the front nut housing 16. Specifically, the front nut engagement face 64 is configured to interlock with the rim face 26 of the front nut housing 16. In this regard, the front nut engagement face 64 is preferably formed as a radial knurl matching the radial knurl of the rim face 26 of the front nut housing 16.

The cable gripping ferrule 36 is generally in the form of a split tube having an axial gap 66 extending the full length of the ferrule. The gap 66 permits the diameter of the ferrule 36 to be reduced more easily so that the ferrule can be uniformly, radially compressed around the insert shaft 32 upon rearward axial movement of the holder sleeve 34, as will be discussed in further detail below. The inner surface 68 of the gripping ferrule is preferably provided with structure to enhance gripping of the outer surface of the cable. Such structure may include internal threads, teeth or some other form of textured surface.

As mentioned above, the outer surface of the cable gripping ferrule 36 is provided with a circumferential ramped portion 62, which engages the rearward end 60 of the holder sleeve 34 upon rearward axial movement of the holder sleeve to radially compress the gripping ferrule. The ramped portion 62 defines a conical segment of the cable gripping ferrule 36 that tapers radially outwardly in the rearward direction. As also described above, the gripping ferrule 36 further includes a retaining lip 50 formed at its rearward end, which is received in an internal groove 48 formed within the axial bore of the back nut housing 28 to prevent rearward movement of the gripping ferrule within the back nut housing.

Operation and installation of the connector 10 will now be described with specific reference to FIGS. 4 and 5. Initially, the end of the coaxial cable 100 that is to be inserted into the rearward end of the back nut housing 28 is prepared in a conventional manner. In particular, cable preparation entails removing about 0.75 inch (19.05 mm.) of cable dielectric 104, outer cable conductor 106 and cable jacket to expose a portion of the center conductor 102 that will engage the pin-terminal assembly 18 of the front nut assembly 12. In addition, about 1.25 inches (31.75 mm.) of the cable dielectric 104 is removed from within the outer cable conductor 106 to provide clearance for the installation of the insert shaft 32, and about 0.5 inch (12.70 mm.) of cable jacket is removed to make an electrical connection with the inside surface 68 of the cable gripping ferrule 36. After the cable end is prepared, it is inserted into the back nut housing 28 so that the portion of the center conductor 102 engages the pin-terminal assembly 18.

The back nut housing 28 is next threadably coupled and rotated with respect to the front nut housing 16 to translate the front nut and back nut assemblies 12, 14 together along their central axes. As the front nut and back nut assemblies 12, 14 are translated closer together, the rim face 26 of the front nut housing 16 engages the forward end 64 of the holder sleeve 34 to translate the holder sleeve towards the rear of the back nut housing 28. The interlocking mating surfaces of the rim face 26 and the first end face 64 cooperate to limit the amount of rotation between the holder sleeve 34 and the front nut housing 16.

The rearward translation of the holder sleeve 34 causes the rearward end 60 of the holder sleeve to engage the outer ramp portion 62 of the gripping ferrule 36 resulting in a radial compression of the ferrule. The radial compression of the ferrule 36 reduces the overall diameter of the ferrule and reduces the axial gap 66 of the ferrule so that the inner threaded surface 68 of the ferrule bites down on the exposed portion of the outer cable conductor 106 and presses the conductor against the insert shaft 32.

However, by providing a slot 56 at the rearward end of the insert shaft 32, the present invention better evenly distributes the closing forces from the gripping ferrule 36 on the forward end of the insert shaft and decreases the forces applied to the back or rearward end of the insert shaft. In particular, in conventional connectors of this type, rearward axial movement of the holder sleeve 34 in the direction of arrow A in FIG. 4 would tend to concentrate the radial compression force on the gripping ferrule 36 at its rearward end. By providing a slot 56 in the insert shaft 32, the radial compressive forces that would be concentrated at the rearward end of the gripping ferrule 36 are now absorbed to some extent by the inward radial deflection of the rearward end of the insert shaft 32 permitted by the slot. As a result, the radial compressive forces are more evenly distributed over the length of the gripping ferrule 36.

The slot 56 of the insert shaft 32 also allows for easier removal of the cable 100 from the connector 10 upon disassembly of the connector. Specifically, the slot 56 of the insert shaft 32 permits a rearward portion of the insert shaft to radially compress, thereby forming an area of decreasing angle against which the gripping ferrule 36 presses. This results in a reduced force being applied at the rearward end of the insert shaft 32 allowing the cable to be more easily removed when desired.

Figure 6:
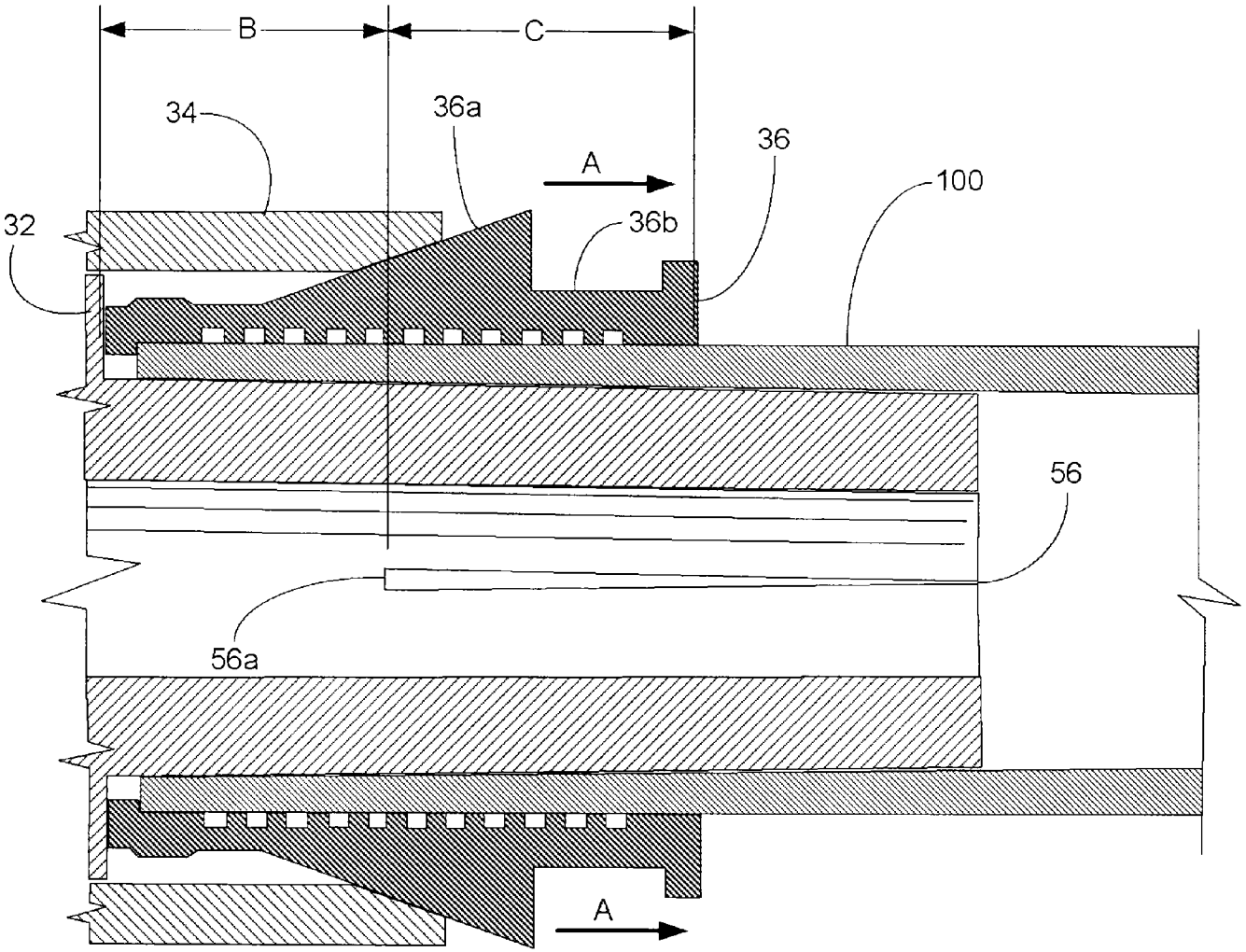
FIG. 6 is an enlarged cross-sectional view of the internal connector components shown in FIG. 5.

As shown in FIG. 6, depending where the gripping ferrule 36, or any other closing mechanism, is axially located with respect to the length of the slot 56 will determine what forces are required to retain the cable 100 around the shaft 32 and its removal. For example, if the slot 56 extends from the rearward end of the shaft 32 to a termination point 56*a* that falls roughly half way along the length of the gripping ferrule 36, the forward half 36*a* of the gripping ferrule will define an area of compression B that has uniform 360 degree contact around the insert shaft 32 required for minimum cable retention, while the rearward half 36*b* of the griping ferrule 36 will define an area of compression C in which the radial compressive forces diminish in the rearward direction A.

As a result of the present invention, the clamping forces provided by the cable gripping ferrule 36 are more accurately distributed to allow the cable to be removed without difficulty, while still maintaining the forces required to connect the cable to the connector.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a back nut housing having a rearward cable receiving end and a forward end opposite said rearward end;

a front nut assembly coupled to said forward end of said back nut housing;

a tubular insert shaft supported within said back nut housing, said insert shaft having a rearward end and an axial slot extending from said rearward end in a forward direction;

a tubular gripping ferrule radially surrounding said insert shaft; and a tubular holder sleeve radially surrounding at least a portion of said gripping ferrule, said holder sleeve being driven in a rearward axial direction into engagement with said gripping ferrule upon coupling of said front nut assembly to said back nut housing, thereby causing said gripping ferrule to radially compress around said insert shaft, wherein said slot in said insert shaft permits said rearward end of said insert shaft to radially compress upon said radial compression of said gripping ferrule.

2. A coaxial cable connector as defined in claim 1, wherein said tubular insert shaft comprises:

a tubular body; and a radially enlarged flanged head portion disposed on a forward end of said tubular body.

3. A coaxial cable connector as defined in claim 1, wherein said slot has a length of about half the length of said tubular insert shaft.

4. A coaxial cable connector as defined in claim 1, wherein said tubular insert shaft is made from a plastic material.

5. A coaxial cable connector as defined in claim 1, wherein said slot is open at said rearward end of said shaft.

6. A coaxial cable connector as defined in claim 1, wherein said slot extends from said rearward end of said tubular insert shaft and terminates at a point mid-way along the length of said tubular gripping ferrule.

7. A coaxial cable connector as defined in claim 6, wherein said termination point of said slot divides said gripping ferrule into a forward half defining an area of compression having substantially uniform circumferential contact around said insert shaft and a rearward half defining an area of compression in which radial compressive forces diminish in a rearward direction opposite said forward direction.

8. An insert shaft for a hard-line coaxial cable connector comprising:

a tubular body having a forward end and a rearward end;

a radially enlarged flanged head portion disposed on said forward end of said tubular body; and an axial slot formed in said tubular body and extending from said rearward end of said tubular body toward said flanged head portion, said axial slot permitting said rearward end of said tubular body to compress radially inward.

9. An insert shaft as defined in claim 8, wherein said axial slot has a length of about half the length of said tubular body.

10. An insert shaft as defined in claim 8, wherein said tubular insert shaft is made from a plastic material.

11. An insert shaft as defined in claim 8, wherein said slot is open at said rearward end of said shaft.

12. An insert shaft as defined in claim 8, wherein said slot extends from said rearward end of said tubular insert shaft and terminates at a point mid-way along the length of said tubular gripping ferrule.

13. An insert shaft as defined in claim 12, wherein said termination point of said slot divides said gripping ferrule into a forward half defining an area of compression having substantially uniform circumferential contact around said insert shaft and a rearward half defining an area of compression in which radial compressive forces diminish in a rearward direction opposite said forward direction.

14. A method for uniformly distributing compressive forces applied by a coaxial cable connector gripping ferrule upon an outer conductor of a coaxial cable, the method comprising the steps of:

removing a length of cable dielectric from an end of a coaxial cable thereby leaving an annular cavity in said cable end between an outer connector and an inner connector of said cable;

inserting a tubular shaft in said annular cavity of said cable end, said tubular shaft having a rearward end and an axial slot extending from said rearward end in a forward direction;

providing a tubular gripping ferrule around an outer surface of said cable outer conductor radially opposite said tubular shaft; and driving a tubular holder sleeve in a rearward direction opposite said forward direction, whereby said sleeve engages said gripping ferrule causing said gripping ferrule to radially compress against said cable outer conductor around said tubular shaft, wherein said slot in said shaft permits said rearward end of said shaft to radially deflect thereby absorbing a portion of the rearward compressive forces applied by said gripping ferrule to more uniformly distribute the compressive forces applied by said gripping ferrule along the length of said gripping ferrule.

15. A method as defined in claim 14, wherein said tubular shaft comprises:

a tubular body; and a radially enlarged flanged head portion disposed on a forward end of said tubular body.

16. A method as defined in claim 14, wherein said slot has a length of about half the length of said tubular shaft.

17. A method as defined in claim 14, wherein said tubular insert shaft is made from a plastic material.

18. A method as defined in claim 14, wherein said slot is open at said rearward end of said shaft.

19. A method as defined in claim 14, wherein said slot extends from said rearward end of said tubular insert shaft and terminates at a point mid-way along the length of said tubular gripping ferrule.

20. A method as defined in claim 19, wherein said termination point of said slot divides said gripping ferrule into a forward half defining an area of compression having substantially uniform circumferential contact around said insert shaft and a rearward half defining an area of compression in which radial compressive forces diminish in a rearward direction opposite said forward direction.

* * * * *